US006911966B2

(12) United States Patent
Hector et al.

(10) Patent No.: US 6,911,966 B2
(45) Date of Patent: Jun. 28, 2005

(54) MATRIX DISPLAY DEVICE

(75) Inventors: Jason R. Hector, Redhill (GB); Mark J. Childs, Sutton (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 278 days.

(21) Appl. No.: 10/210,475

(22) Filed: Aug. 1, 2002

(65) Prior Publication Data

US 2003/0038767 A1 Feb. 27, 2003

(30) Foreign Application Priority Data

Aug. 24, 2001 (GB) ..... 0120542
Dec. 22, 2001 (GB) ..... 0130807

(51) Int. Cl.[7] ..... G09G 3/36

(52) U.S. Cl. ..... 345/96; 345/87; 345/101; 345/209

(58) Field of Search ..... 345/87–104, 204, 345/209, 211, 212

(56) References Cited

U.S. PATENT DOCUMENTS 5,130,829 A 7/1992 Shannon ..... 359/59
5,408,335 A * 4/1995 Takahashi et al. ..... 358/443
6,392,626 B1 * 5/2002 Moon ..... 345/94
6,424,330 B1 * 7/2002 Johnson ..... 345/96
2002/0053999 A1 * 5/2002 Chou ..... 345/58
2003/0030744 A1 * 2/2003 Baer ..... 348/370
2003/0043138 A1 * 3/2003 Hector et al. ..... 345/209
2003/0098835 A1 * 5/2003 O'Donnell et al. ..... 345/87

* cited by examiner

*Primary Examiner*—Bipin Shalwala
*Assistant Examiner*—David L. Lewis

(57) ABSTRACT

A matrix display device (60) comprises an array of pixels for producing a display output in response to drive signal voltages using an inversion drive scheme. Display artefacts, especially flicker, are corrected for by connecting together, in parallel, two pixels (31), previously addressed with respective drive signal voltages of opposite polarity, and measuring a residual voltage caused by a difference in charge stored on the two pixels due to a DC offset present in the pixels. The measured voltage is used to modify subsequent drive signal voltages for the pixels in order to reduce the measured voltage, i.e. towards zero, thus reducing display artefacts caused by the DC offset in the pixels. The invention is particularly applicable to transmissive type liquid crystal display devices.

11 Claims, 4 Drawing Sheets

MATRIX DISPLAY DEVICE

The present invention relates to a matrix display device comprising an array of electro-optical display pixels coupled to sets of address conductors to which drive signals are applied by drive circuit means in order to drive the display pixels. The invention is concerned particularly, but not exclusively, with liquid crystal matrix display devices and especially active matrix liquid crystal display (AMLCD) devices.

Liquid crystal (LC) matrix display devices, both passive and active matrix type, are well known. Such devices are commonly used in monitors, lap-top computers, TVs and like products. A typical example of an AMLCD and its manner of operation is described in U.S. Pat. No. 5,130,829 whose contents are incorporated herein by way of reference material. Briefly, such a display device comprises an array of pixels, arranged in rows and columns, each comprising an electro-optic cell and an associated switching device, usually in the form of a thin film transistor (TFT). The pixels are connected to sets of row and column address conductors, each pixel being located adjacent the intersection between a respective conductor of each set, via which the pixels are addressed with selection (scanning) signals being applied to each of the row conductors in sequence to select that row and with data (video information) signals being supplied in synchronism with row selection signals via the column address conductors to the pixels of the selected row and determining the display outputs of the individual pixels of the row concerned. The data signals are derived by appropriately sampling an input video signal in a column address circuit coupled to the column address conductors. Each row of pixels is addressed in a respective row address period in turn so as to build up a display from the whole array in one field (frame) period, with the array of pixels being repeatedly addressed in this manner in successive fields. There is a need to refresh the pixels regularly with video information due to losses which occur in the pixels. In the case of an AMLCD, the polarity of the data signal voltage applied to the LC cells needs to be inverted periodically in order to prevent degradation of the LC material. This may be done for example after each field (so-called field inversion) or after each row has been addressed as well (so-called line or row inversion). Nevertheless, it has been found that, due to different causes, a parasitic DC offset may be produced across the layer of liquid crystal material. Kickback, a phenomena well known in the art of AMLCDs, is, for example, a cause of DC offset across the cells.

The DC offset affects the drive of a pixel differently for opposite polarities in successive frame times. When the absolute voltages across a pixel in successive frame periods (for a given data, (video information), signal) differ, this will give rise to flicker at half the frequency of the frame frequency used (generally 50 or 60 Hz) which is clearly visible in the display image.

FIG. 1 shows a plot of a pixel's LC cell transmission T against voltage V across the cell. It can be seen that the transmission is substantially the same for equal but opposite voltages and that the plot about the vertical axis is generally symmetrical. An example DC offset, Y, is shown on the plot. The driving voltage D applied by the column address conductors to the cell is therefore offset. For the positive part of the inversion drive, the voltage across the cell is Y+D. For the negative part of the inversion drive, the voltage across the cell is Y−D. It can be seen that the transmissions reached for the opposite polarities of drive with a given value of D are different and vary by X %. Therefore, for a steady driving data signal of magnitude D, the cell transmission will change by X % over two frame periods. This causes flicker at half the frame frequency.

To reduce the flicker exhibited in this way, it is well known to adjust the voltage applied across the cell. For example, this can be done by adjusting the voltage on the common electrode for successive frames. The common electrode is driven with a predetermined drive-scheme. For example, the common electrode voltage is modulated with a square wave. In order to correct for DC offset, the average DC of the drive scheme waveform is adjusted without changing the peak-to-peak AC voltage. The common electrode is typically a transparent electrode common to all pixels.

A conventional technique to set the common electrode voltage levels required is a manual adjustment procedure at the time of manufacturing the device. This is time consuming and expensive.

WO 99/57706, whose contents are incorporated herein by way of reference material, discloses a flicker sensor wherein the voltage difference is measured across dummy pixels driven with opposite polarity. The dummy pixels have the same environment as the pixels forming the image-producing display. The voltage differences concerned are of the order of mV. Any leakage across the LC cells disturbs the common electrode drive-scheme waveform. Therefore the differences in voltage are very difficult to measure.

It is therefore an object of the present invention to provide an improved matrix display device of the type described above. It is another object of the present invention to provide a matrix display device in which the above-mentioned drawbacks are at least partly obviated.

According to the one aspect of the present invention, there is provided a matrix display device comprising an array of pixels for producing a display output in response to drive signal voltages applied by drive circuit means during address periods with the polarity of the drive signal voltages being periodically inverted, and correction means for modifying drive signals to correct for display artefacts, wherein the correction means comprises two pixels arranged so as to be addressed by the drive circuit means with respective drive signals of opposite polarity during an associated address period and the correction means is arranged to connect the two pixels together in parallel during a measure period, following the associated address period, and to measure a voltage on the connected two pixels, the correction means modifying the drive signal voltages for the pixels in accordance with said measured voltage.

The invention enables a reduction in flicker effects. The connected pixels produce a non-zero voltage when there is a DC offset present in the pixels. This voltage is measured and drive signals are modified in response, so as to reduce the measured voltage, towards zero, for subsequent frame periods. Therefore, the DC offset is corrected for and flicker is thus reduced.

In a preferred embodiment, each pixel in the array is formed at the intersection of crossing sets of row and column conductors and comprises an electro-optic display cell disposed between two opposing electrodes to which the drive signal voltages are applied. The correction means may further comprise measuring means for measuring the potential difference across the opposing electrodes of the connected pixels during the measure period and for adjusting the drive signal voltages in response to that difference so as to minimise the potential difference, i.e. such that the difference tends towards zero. The adjusted drive voltages may be applied to an electrode common to all pixels.

According to another aspect of the present invention there are provided a method of driving a matrix display device comprising an array of pixels, drive circuit means operable to address the pixels with drive signal voltages during address periods, the polarity of the drive signal voltages being periodically inverted, and correction means for modifying drive signal voltages, wherein the method comprises the steps of:

addressing two pixels with respective drive signal voltages of opposite polarity during an associated address period;

connecting together, in parallel, the two pixels during a measure period, following the associated address period;

measuring a voltage on the connected two pixels; and, modifying the drive signal voltages for the pixels in accordance with said measured voltage.

Further features and advantages of the present invention will become apparent from reading of the following description of preferred embodiments, given by way of example only, and with reference to the accompanying drawings, in which.

It should be understood that the Figures are merely schematic and are not drawn to scale. In particular, certain dimensions may have been exaggerated whilst others have been reduced. The-same reference numerals are used throughout the drawings to indicate the same or similar parts.

Figure 1:
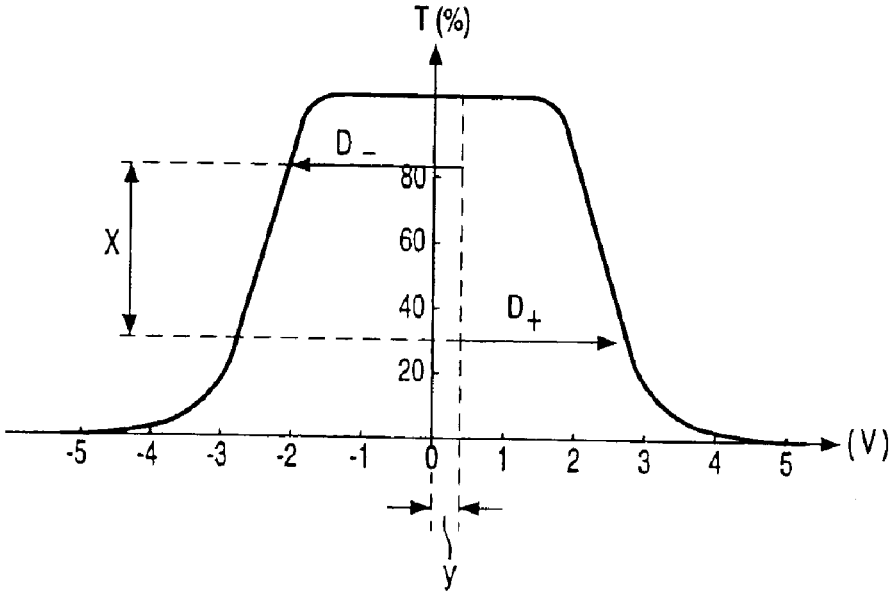
FIG. 1 shows the transmission-voltage (T-V) relationship for a typical LC cell in known matrix LC display devices.
Figure 3:
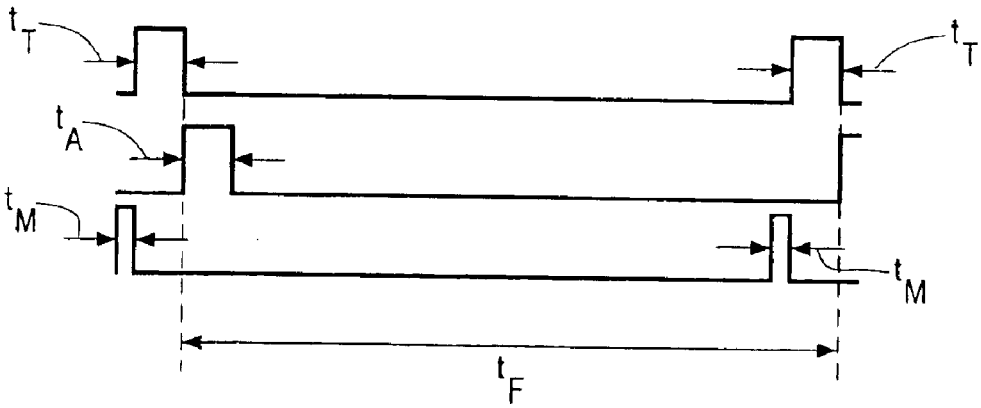
FIG. 3 shows examples of signal waveforms applied to the circuit of FIG. 2 during the frame period.
Figure 2:
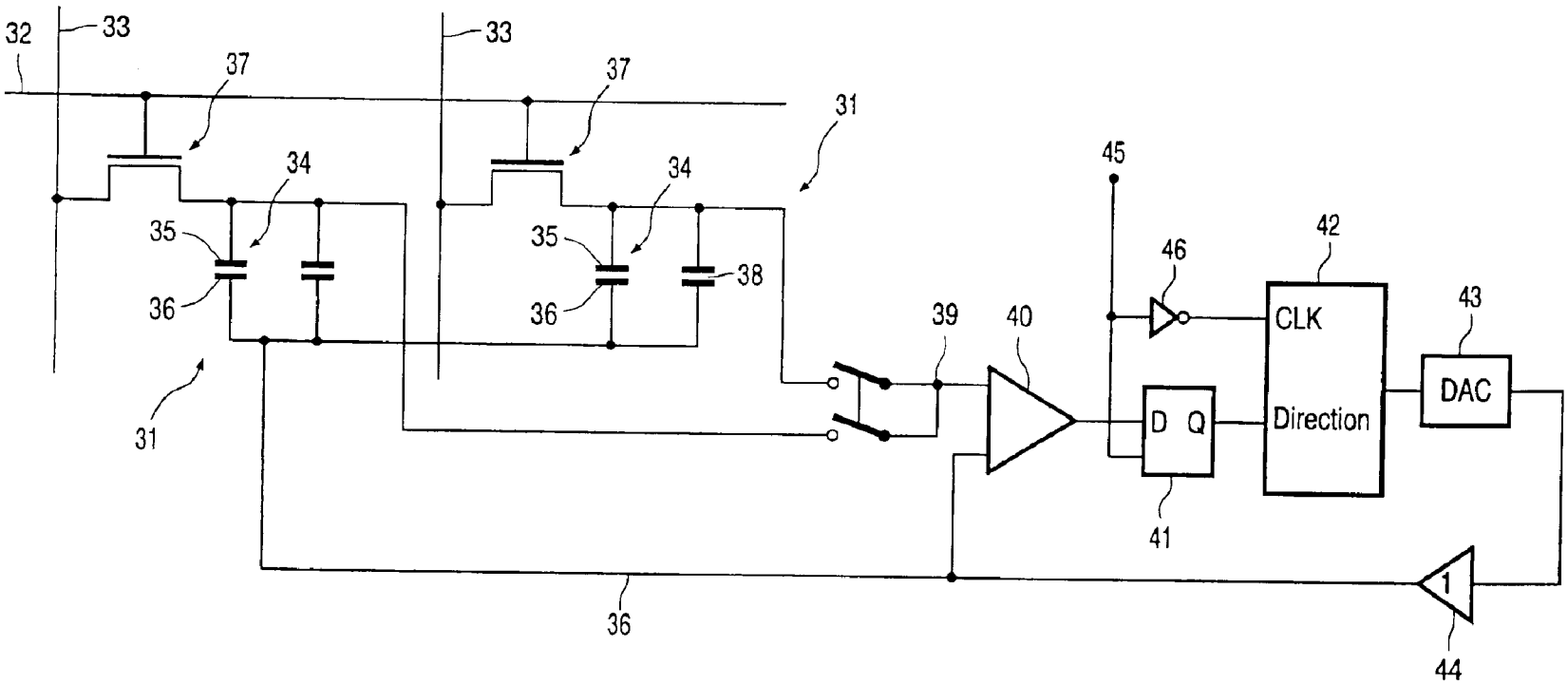
FIG. 2 shows schematically the circuit of part of an embodiment of display device according to the present invention.

A first embodiment of the invention will now be described with reference to FIGS. 2 and 3. FIG. 2 illustrates schematically a circuit diagram for part of a display device according to a first embodiment of the present invention, and comprising an AMLCD device. The device is a transmissive type device, and the term "transmission" used herein in relation to the LC cell should be construed accordingly. FIG. 3 shows various signal waveforms applied in operation of the circuit. Two dummy pixels 31 are shown. Each dummy pixel 31 is equivalent to a display pixel in the device's array of display pixels and comprises a switching element in the form of a TFT 37 whose gate is connected to a respective row (selection) conductor 32 and whose source and drain electrodes are connected respectively to a respective column (data) conductor 33 and pixel electrode 35 and driven with similar kinds of drive signals (selection and data) as the display pixels. These are located adjacent the edge of the display area and do not form part of the image-creating array of display pixels. Drive (selection) signals from a row driver circuit select the pixels by turning on their TFTs 37 whose gate electrodes are electrically connected to a row conductor 32, and the source electrodes are electrically connected to the column conductors 33. For each dummy pixel 31 the signal present at the column conductor 33 is transferred via the TFT 37 to a pixel electrode 35 coupled to the drain electrode and forming a first side of a LC cell 34. The opposite electrodes of the cells comprise respective portions of a common electrode 36. Each LC cell thus behaves as a parallel-plate capacitor as is indicated in the Figure. A storage capacitor 38 is connected in parallel with each LC cell, as is conventional.

The dummy pixels 31 are preferably identical in construction to the pixels in the display array and have the same environment. Therefore, they experience the same DC offset that can result in the flicker of the image displayed.

The two dummy pixels 31 are addressed, during an address period $t_A$, corresponding to a row address period, with a reference data signal having the same voltage magnitude but with opposite polarities. After the address period, and for the remainder of the frame period the voltage stored on the pixel capacitance will change slightly.

Figure 4:
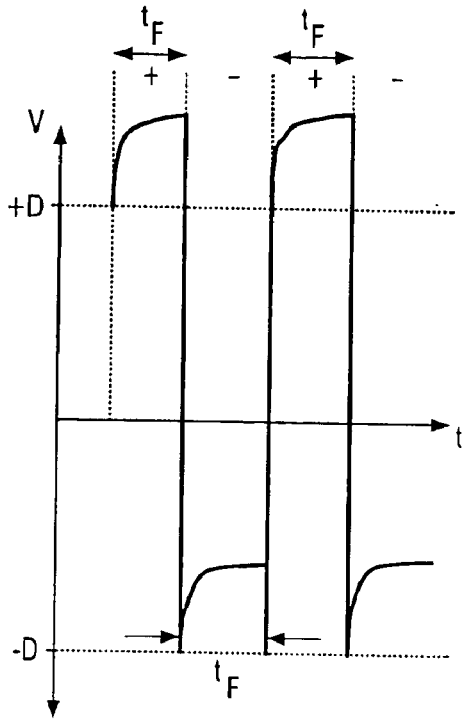
FIG. 4 is a plot of voltage across a typical LC cell against time without flicker correction according to the present invention.

FIG. 4 illustrates the nature of the change of stored pixel voltage in the case of a conventional type of AMLCD over a few frame periods. The plot shows the voltage across a cell where the periodically inverted driving voltage is offset by the electrical asymmetry described above. Therefore, any measurements taken to correct for flicker are preferably taken at the end of the frame period $t_F$. As well as the evolution of voltage across the cell, the capacitance of the cell changes with time and with voltage. Therefore, due to the DC offset, the charge stored on one plate of a capacitor will not be of an equal magnitude for the positive and negative parts of the inversion cycle. This property is exploited to provide a flicker sensor by measuring the difference in charge stored on the two pixel electrodes of the dummy pixels.

In the device of FIG. 2, similar changes occur to the pixel voltage in the initial frame periods but thereafter, the effect differs, as will become apparent.

Referring again to FIG. 2, towards the end of the frame period $t_F$ a switch 39, preferably double-pole, is closed for a measure period $t_M$ comprising a relatively short period close to the end of the frame period $t_F$. This shorts together the pixel electrodes 35 of the oppositely charged dummy pixels 31. A difference in charge stored at the frame end will result in a non-zero voltage at the pixel electrodes of the dummy pixels when the shorting occurs over the measure period $t_M$. The switch 39 is preferably of low-leakage in the off-state as the capacitances of the dummy pixels 31, and hence the charges stored, are relatively low. The output of the switch 39 is connected to one input of a comparator 40. The voltage supply line of the common electrode 36 is connected to a second input of the comparator 40. Therefore, the comparator 40 is arranged so as to measure the potential difference across the opposing electrodes, 35 and 36, of the connected pixels. The input voltage to the comparator is analogous to the charge stored on the dummy pixels after the measure period $t_M$. The comparator is preferably of very high impedance and very high gain. The output from the comparator 40 is connected to a first input of a latch circuit 41, e.g. a flip-flop. A timing pulse $t_T$ (whose relative timing is shown in FIG. 3) is applied to a second input of the latch circuit 41 from an input 45. The output of the latch 41 is connected to a first input of a counter 42. An inverter 46, with the timing pulse $t_T$ applied to its input, has its output connected to a second input of the counter 42. The counter 42 steps the value on a digital-to-analogue converter (DAC) 43 up or down one value, depending on the polarity of the signal passed by the latch 41. The DAC 43 then adjusts the voltage on the common electrode 36, via a buffer 44, for the next frame period, so as to minimise the potential difference measured by the comparator 40, i.e. such that the difference tends towards zero.

It is envisaged that the flicker sensor of the first embodiment may comprise more than two dummy pixels. For example, two identical rows of pixels could be charged to equal voltages with opposite polarities. An advantage of this arrangement is that a greater residual charge will result due to the increased area of pixel electrodes 35 which is easier to sense by the comparator 40 leading to greater accuracy in the flicker correction. Another advantage of using more than two dummy pixels, for example, by using a pair of rows each having the pixels connected together, is that any inaccuracies due to deficient pixels are averaged out over the remaining pixels in that row.

It is also envisaged that the dummy pixels 31 may be scaled up in size so as to increase the capacitance of each pixel. Again, this will increase the residual voltage sensed by the comparator 40 and thus increase the accuracy of the correction.

Although the embodiments described above relate to transmissive type displays, it is envisaged that the invention may also be applied to reflective type AMLCDs. In this type of display, the reflective electrodes are normally made from a different material to the transmissive electrodes. This produces an intrinsic DC offset across the LC cell which is not present across the parallel connected storage capacitor 38. Therefore it may be necessary to connect an additional LC cell in parallel with the existing LC cell 34 instead of the storage capacitor 38 shown in the embodiment of FIG. 2.

Figure 5:
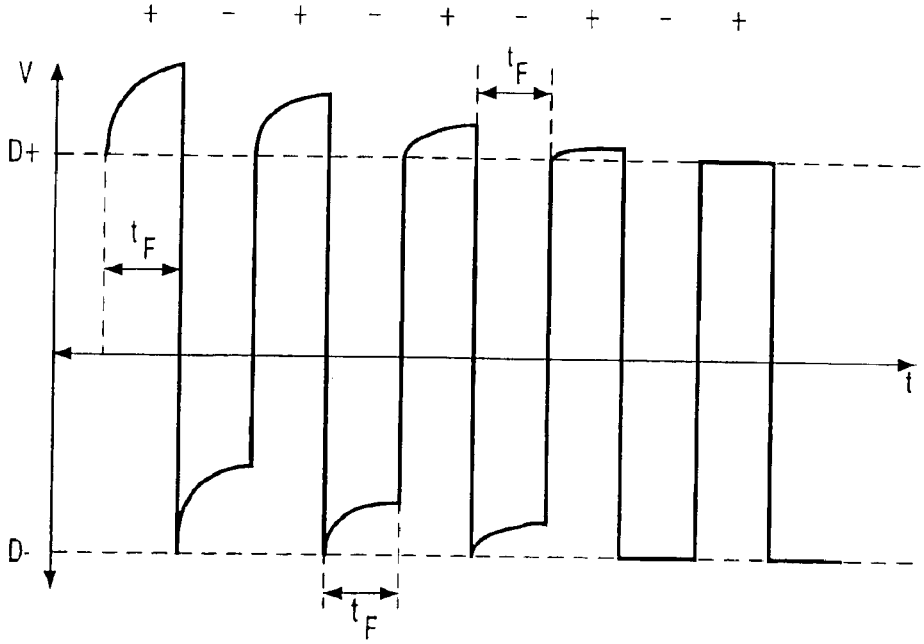
FIG. 5 is a plot of voltage across a LC cell against time with flicker correction in accordance with the present invention.

With reference to FIG. 5, it can be seen that the flicker correction circuit, as described with reference to FIG. 2, adjusts the common electrode voltage over a several frames such that the voltage across the cell V tends towards the driving voltage D. A small number of measurements may be sufficient over a small number of frame periods $t_F$, as shown in FIG. 5. In another embodiment, measurement and correction are performed once, for example when switching on the matrix display device, or periodically.

Figure 6:
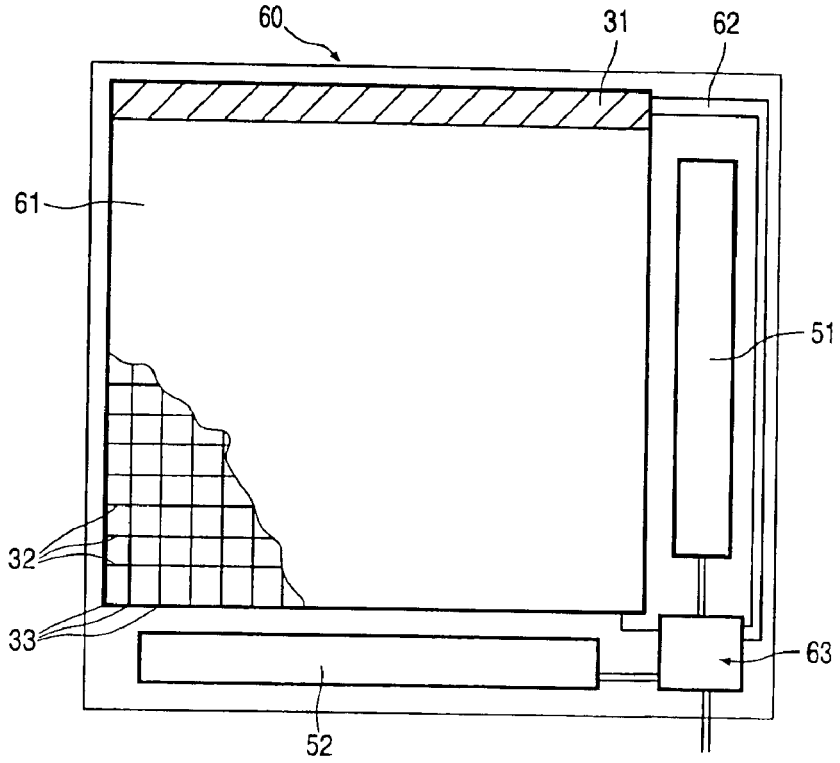
FIG. 6 shows schematically an embodiment display device according to the present invention.

A preferred embodiment of a display device according to the present invention is shown schematically in FIG. 6. The display device, here referenced 60, is an AMLCD comprising a display panel 61 comprising an array of display pixels forming a display area. Each pixel is addressed by corresponding row and column conductors, 32 and 33, as in conventional AMLCD devices. A row driver circuit 51 and a column driver circuit 52 are located adjacent respective edges of the panel. The row driver circuit 51 selects one row of pixels at a time. In sequence the selected row of pixels is addressed with data signals from the column driver circuit 52 via the associated column conductors 33.

Dummy pixels 31 are located adjacent another edge of the display panel 61. They may be addressed by the row and column conductors in the same way as the pixels in the display pixel array. They are charged with data signals of opposite polarity as described hereinbefore. Connections 62 are made between the respective pixel electrodes 35 and the flicker correction circuitry as shown in FIG. 2.

The circuitry may be remote from the driver ICs or incorporated within them. In the preferred embodiment shown in FIG. 6, using for example polysilicon technology, the panel 61 includes a timing and control circuit 63 to which a video signal is applied and which provides data signals to the column drive circuit, timing signals to the row drive circuit and a voltage signal to the common electrode. The control circuit 63 includes the flicker correction circuit and the voltage from the dummy pixels is supplied to this circuit.

The dummy pixels are preferably addressed with data signals corresponding to a mid-range grey scale. This enhances the flicker effect thus making it easier to detect.

Figure 7:
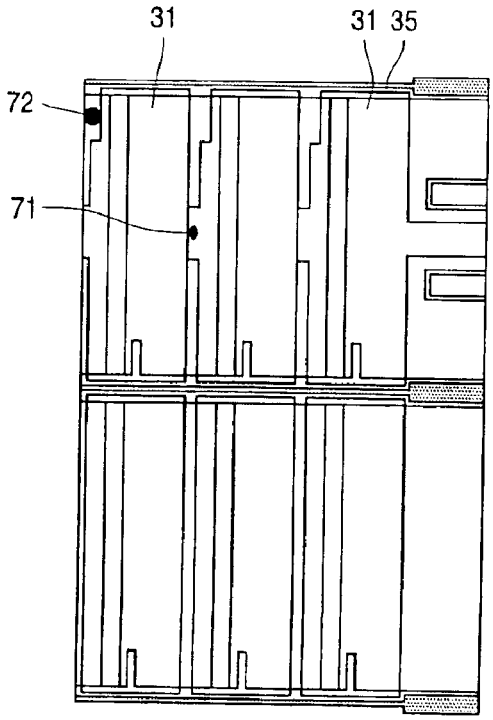
FIG. 7 shows schematically a display device having a preferred pixel layout according to one aspect of the present invention.

With reference to FIG. 7, the dummy pixels 31, for example, that are in the same row and are charged to the same polarity for the use within the correction circuit, may be connected together by using a modified shape of pixel electrode 35 for each dummy pixel 31. A tab 71 is used to connect adjacent pixel electrodes 35 together. In order to compensate for the increased area of each pixel electrode, a tab 72 of the same area as added tab 71 is removed from an area, for example a corner, of each pixel electrode 35. This ensures that the capacitance of the dummy pixels is equal to the capacitance of the display pixels.

Although it is preferable that dummy pixels 31 are used in the correction circuit, it is envisaged that pixels forming part of the display area may be employed for this function.

A further embodiment of the invention comprises an analogue system in contrast to the digital counter system used in the embodiment described with reference to FIG. 2. In this embodiment, the dummy pixels are again shorted together as before. However, the resultant signal is passed to an integrator. The integrator is chosen to have a time constant several times that of the frame period $t_F$. The output of the integrator can then be processed either in the analogue or digital domain, the result from which is used to adjust the common electrode 36 in the same way as described before.

Although described in relation to AMLCDs in particular, it is envisaged that the invention could be applied also to passive type LCDs to counteract the effect of DC offset voltages and also other types of matrix display devices having arrays of capacitive type electro-optical display pixels.

In summary of the device described herein, a matrix display device comprises an array of pixels for producing a display output in response to drive signal voltages using an inversion drive scheme. Display artefacts, especially flicker, are corrected for by connecting together, in parallel, two pixels, previously addressed with respective drive signal voltages of opposite polarity, and measuring a residual voltage caused by a difference in charge stored on the two pixels due to a DC offset present in the pixels. The measured voltage is used to modify subsequent drive signal voltages for the pixels in order to reduce the measured voltage, i.e. towards zero, thus reducing display artefacts caused by the DC offset in the pixels. The invention is particularly applicable to transmissive type liquid crystal display devices.

From the present disclosure, many other modifications and variations will be apparent to persons skilled in the art. Such modifications and variations may involve other features which are already known in the art and which may be used instead of or in addition to features already disclosed herein.

What is claimed is:

1. A matrix display device comprising an array of pixels for producing a display output in response to drive signal voltages applied by drive circuit means during address periods with the polarity of the drive signal voltages being periodically inverted, and correction means for modifying drive signals to correct for display artefacts, wherein the correction means comprises two pixels arranged so as to be addressed by the drive circuit means with respective drive signals of opposite polarity during an associated address period and the correction means includes a switch adapted to short respective electrodes of the two pixels together during a measure period, following the associated address period, and to measure a voltage on the connected two pixels, the correction means modifying, the drive signal voltages for the pixels in accordance with said measured voltage.

2. A matrix display device according to claim 1, wherein each pixel in the array is formed at the intersection of crossing sets of row and column conductors and comprises an electro-optic display cell disposed between two opposing electrodes to which the drive signal voltages are applied.

3. A matrix display device according to claim 2, wherein one of said electrodes of a pixel is common to all pixels in the array and the correction means is arranged to apply the modified drive signal voltages to the common electrode.

4. A matrix display device according to claim 2, wherein the correction means further comprises measuring means for measuring the potential difference across the opposing electrodes of the connected pixels during the measure period and for adjusting the drive signal voltages in response to that difference so as to minimise the potential difference.

5. A matrix display device according to claim 4, wherein the correction means further comprises a digital counter circuit connected to the output of the measuring means, and to which timing signals are applied, operable to adjust the drive signal voltages, at intervals determined by the timing signals, in response to the output of the measuring means.

6. A matrix display device according to claim 2, wherein each of said two pixels includes a storage capacitance connected in parallel with the display cell.

7. A matrix display device according to claim 1, wherein the display device comprises a transmissive type liquid crystal display device.

8. A matrix display device according to claim 2, wherein each of said two pixels further comprises a further electro-optic display cell connected in parallel with the first-mentioned display cell.

9. A matrix display device according to claim 1, wherein the display device comprises a reflective type liquid crystal display device.

10. A matrix display device according to claim 1, wherein said two pixels comprise dummy pixels located at the edge of the array.

11. A method of driving a matrix display device comprising an array of pixels, drive circuit means operable to address the pixels with drive signal voltages during address periods, the polarity of the drive signal voltages being periodically inverted, and correction means for modifying drive signal voltages, wherein the method comprises the steps of:

addressing two pixels with respective drive signal voltages of opposite polarity during an associated address period;

providing a switch;

connecting the switch to short respective electrodes of the two pixels together during a measure period, following the associated address period;

measuring a voltage on the connected two pixels; and, modifying the drive signal voltages for the pixels in accordance with said measured voltage.

* * * * *